US008459180B2

(12) United States Patent
Paupardin et al.

(10) Patent No.: US 8,459,180 B2
(45) Date of Patent: Jun. 11, 2013

(54) INSTALLATION FOR THE TEMPERATURE TREATMENT OF PRODUCTS STORED ON PALLETS OR SIMILAR

(75) Inventors: Michel Paupardin, Neufchatel Hardelot (FR); Benoit Paupardin, Carly (FR)

(73) Assignee: Fromfroid, Isques (FR)

( * ) Notice: Subject to any disclaimer, the term of this patent is extended or adjusted under 35 U.S.C. 154(b) by 1000 days.

(21) Appl. No.: 11/919,547

(22) PCT Filed: Mar. 20, 2007

(86) PCT No.: PCT/FR2007/050955

§ 371 (c)(1),
(2), (4) Date: Nov. 20, 2007

(87) PCT Pub. No.: WO2007/122334

PCT Pub. Date: Nov. 1, 2007

(65) Prior Publication Data

US 2010/0025020 A1 Feb. 4, 2010

(30) Foreign Application Priority Data

Apr. 21, 2006 (FR) ..... 06 03570
Jan. 23, 2007 (FR) ..... 07 52825

(51) Int. Cl.
*A23L 3/00* (2006.01)
*F26B 25/06* (2006.01)
*A47J 27/04* (2006.01)

(52) U.S. Cl.
USPC ..... 99/473; 34/231

(58) Field of Classification Search
USPC ..... 198/463.1, 795; 62/440, 441, 442, 62/237, 406, 407, 447; 34/210, 216, 217, 34/218, 231; 454/192
See application file for complete search history.

(56) References Cited

U.S. PATENT DOCUMENTS

| | | | | |
|---|---|---|---|---|
| 3,638,450 | A | 2/1972 | Falk | |
| 3,772,839 | A * | 11/1973 | Timbers | 52/173.2 |
| 3,816,867 | A * | 6/1974 | Shirzad et al. | 14/71.5 |
| 3,878,509 | A * | 4/1975 | Kikuchi et al. | 382/223 |
| 4,574,543 | A * | 3/1986 | Crosson | 52/173.2 |
| 4,738,082 | A * | 4/1988 | Saitoh | 53/557 |
| 4,799,342 | A * | 1/1989 | Klevnjans | 52/173.2 |
| 5,125,196 | A * | 6/1992 | Moody | 52/173.2 |
| 5,466,030 | A * | 11/1995 | Harris et al. | 296/98 |
| 5,522,238 | A * | 6/1996 | Miller | 62/374 |
| 5,778,557 | A * | 7/1998 | Leavens | 34/222 |
| 6,122,839 | A * | 9/2000 | D'Hollander | 34/492 |
| 7,621,285 | B2 * | 11/2009 | Robert et al. | 134/61 |

FOREIGN PATENT DOCUMENTS

| | | | |
|---|---|---|---|
| DE | 22 56 943 | A1 | 11/1974 |
| DE | 92 02 378 | U1 | 4/1992 |
| DE | 100 17 408 | A1 | 10/2001 |
| DE | 20 2004 020618 | U1 | 10/2005 |
| EP | 0 430 048 | A1 | 6/1991 |
| GB | 2079917 | * | 1/1982 |

* cited by examiner

*Primary Examiner* — Gene Kim
*Assistant Examiner* — John E Simms, Jr.
(74) *Attorney, Agent, or Firm* — Kenyon & Kenyon LLP

(57) ABSTRACT

The invention concerns an installation for the temperature treatment of products placed on pallets or similar, including at least one chamber, means for the introduction of a pallet, means for conveyance of the pallet between an entrance and an exit, and means for blowing air through the products on a pallet. It is characterized in that the installation also includes raisable, longitudinal separation means, placed substantially on the main axis of the said at least one chamber, which are used to prevent the passage of air between the top surface of each pallet present in the chamber and the ceiling of the said at least one chamber.

12 Claims, 5 Drawing Sheets

INSTALLATION FOR THE TEMPERATURE TREATMENT OF PRODUCTS STORED ON PALLETS OR SIMILAR

This is a 371 national phase application of PCT/FR2007/050955 filed 20 Mar. 2007, claiming priority to French Patent Application No. FR 0603570 filed 21 Apr. 2006, and No. FR 0752825 filed 23 Jan. 2007, respectively, the contents of which are incorporated herein by reference.

This present invention concerns an installation for the temperature treatment of products stored on pallets or similar.

This present invention will find its main application in the creation of a treatment installation with a view to the cooling or the temperature treatment of products, and more particularly of products in the food production area.

However, although it is particularly intended for such an application, the treatment installation can also be used for other applications and in particular for the heating of products in the foodstuffs area or indeed in many such areas.

In the remainder of the application, "pallet or similar" refers to any type of support used for the storage and the handling of products, and stacked products in particular. By way of an example, it can concern double-sided pallets with two entries, single-sided stringer pallets, pallets with four entries of the reversible stringer or block type, reversible pallets of the reversible stringer or block type, riveted or nailed, or half-pallets with four entries.

Of course these pallets can be of variable length and width, since the height of the assembly formed by the products on the pallet are also capable of varying considerably and in particular, it is possible to introduce both full pallets and half pallets into the temperature treatment installation.

We are already familiar with installations pallets on the market for the temperature treatment of products placed on.

In general, these installations include at least one chamber, means for the introduction of a pallet, and means for conveyance of the pallet, where these conveyance means can be implemented in particular by conveyor belts.

These installations also include air-blowing means used to pass the air through the pallets with a view in particular of heating, cooling or maintaining the temperature within the pallets.

Conventionally, the air-blowing means are composed of fans that create a movement of air, where these fans work together with exchangers used to heat or cool this air.

In certain installations, in order to allow cooling in an even manner of the pallet passing through the installation, several chambers are provided with air-blowing means which blow in a manner that alternates from one chamber to the next and, for example, from left to right in relation to the direction of conveyance of the pallets in one chamber and from right to left in another chamber.

The treatment installations on the market display some considerable advantages, and in particular the ability to process pallets continuously.

However, these installations also display some drawbacks, including the difficulty of controlling and adjusting the temperature of the products on the pallets in a fine manner.

Furthermore, another drawback of this type of treatment installation concerns the poor channeling of the air in the installation.

In fact in order for the installation to be effective, it is necessary that a maximum of air should pass through the products so as to achieve good heat exchange. Now given the free space between the top of the pallets and the ceiling of the installation, a large part of the air passes above the pallets, thus reducing the cooling capabilities of the installation.

In order to remedy these drawbacks, there have been proposals to provide fixed baffles, placed between the ceiling of the installation and the top of the pallets. This solution is not satisfactory however, since the rigid baffle can damage the products on the pallets and in particular, when these pallets are moved, can cause the products to fall from the pallets.

Another drawback concerns the fact that the pallets introduced into the installation are not necessarily all of the same height, and that the baffle can be lowered only to the height of the tallest pallets so that, as a consequence, there are always some large free spaces above the lowest pallets.

It is also important to emphasise that this baffle system is quite difficult to position because, before the treatment of every series of pallets, it is necessary to manually adjust the height of this baffle to the maximum foreseeable height of the pallets that can enter the installation.

Finally, another drawback of these conventionally used installations is the absence of airtightness between the chambers themselves, this being particularly prejudicial when the air-blowing means of each chamber are opposite, since low pressure will occur in one chamber where there is high pressure in the chamber opposite, thus drawing the air from one chamber directly into the second chamber, so that as a consequence, this air does not pass through the pallets and so is not useful.

Given these drawbacks, the treatment installations currently on the market have low energy efficiency and do not allow the temperature of the products placed on the pallets to be adjusted in a satisfactory manner.

The purpose of this present invention is to overcome the aforementioned drawbacks and to propose an installation for the temperature treatment of products that limits the "by-passing" effect of the air, and as a consequence that increases the energy efficiency of the installation.

Another aim of this present invention is to propose an installation for the temperature treatment of products placed on pallets and used to eliminate and/or considerably limit the free space between each pallet and the ceiling of the installation.

Another aim of this present invention is to propose an installation for the temperature treatment of products that is able to deal with pallets of very variable height in a given series and both the full pallets and half pallets for example.

Another aim of this present invention is to propose an installation for the temperature treatment of products placed on pallets, in which all of the operations are carried out automatically.

The subject of the invention is thus an installation for the temperature treatment of products stored on pallets or similar, consisting of at least one chamber, means for the introduction of a pallet, means for the conveyance of the pallet between an entrance and an exit, and means for blowing air through the products placed on the pallet.

According to the invention, the installation also includes raisable, longitudinal, separation means, placed substantially in the main axis of the said at least one chamber, and used to prevent the passage of air between the surface of each pallet present in the chamber and the ceiling of the said at least one chamber.

Other characteristics and advantages of the invention will appear more clearly on reading the description that follows of a preferred example of implementation in which the description is provided only by way of a non-limiting example, and with reference to the appended drawings in which.

Figure 4:
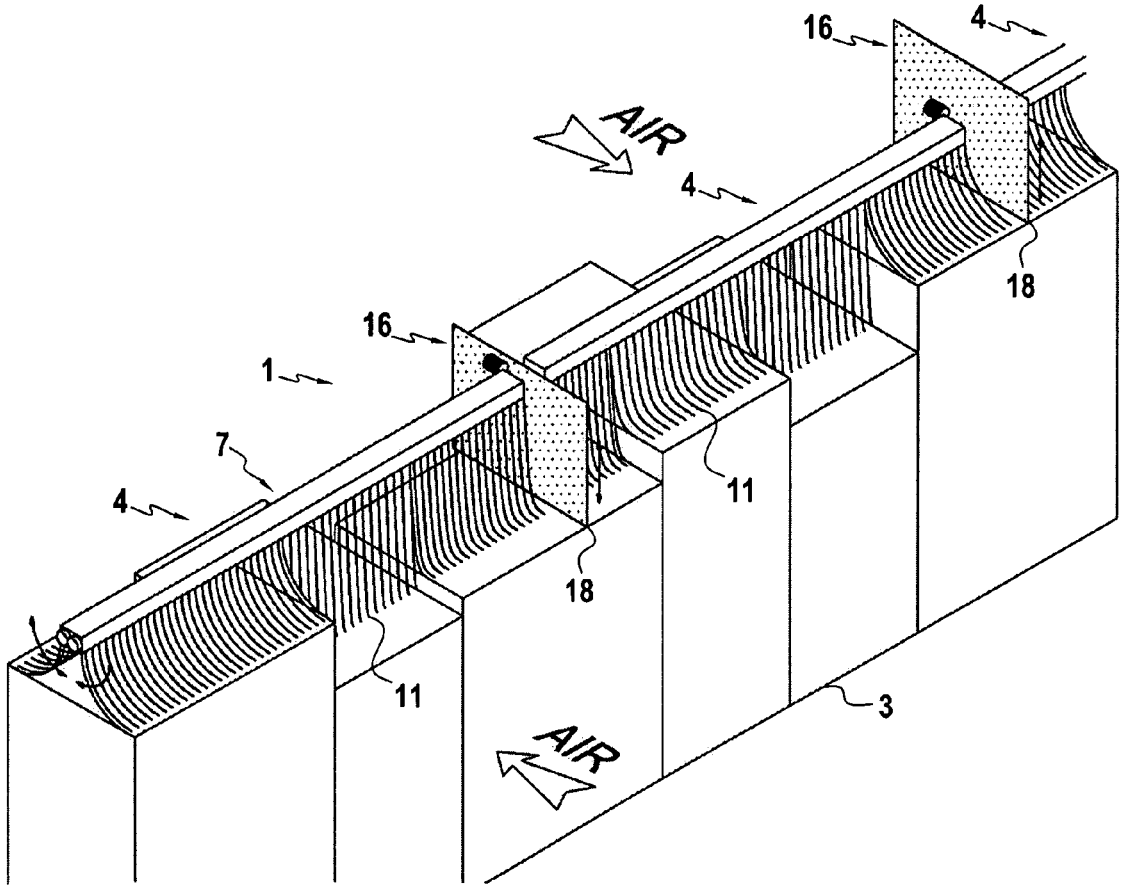
Figure 5:
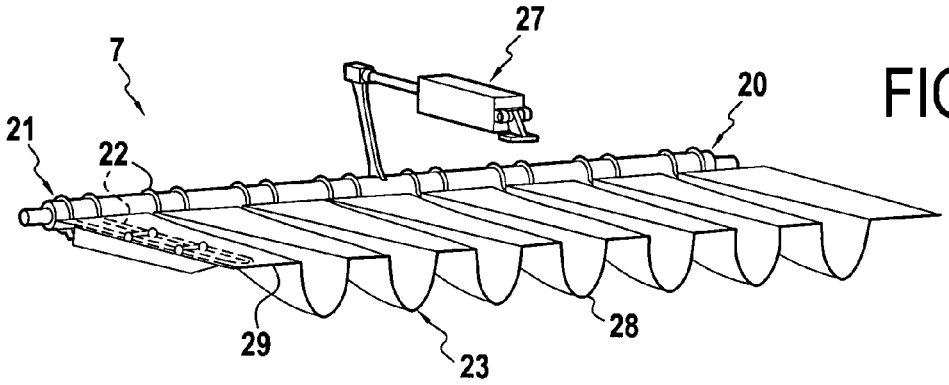
Figure 6:
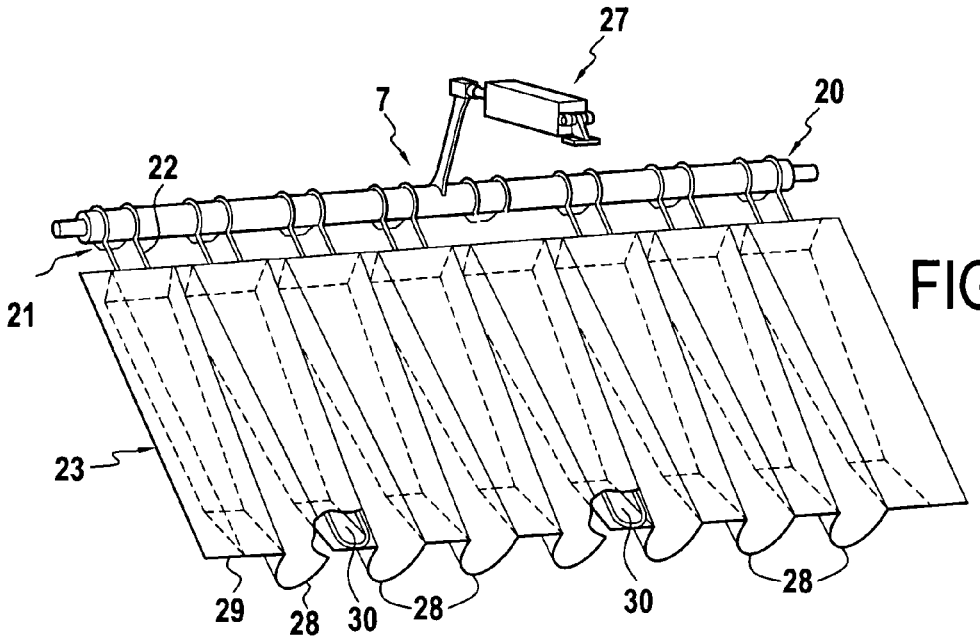
Figure 7:
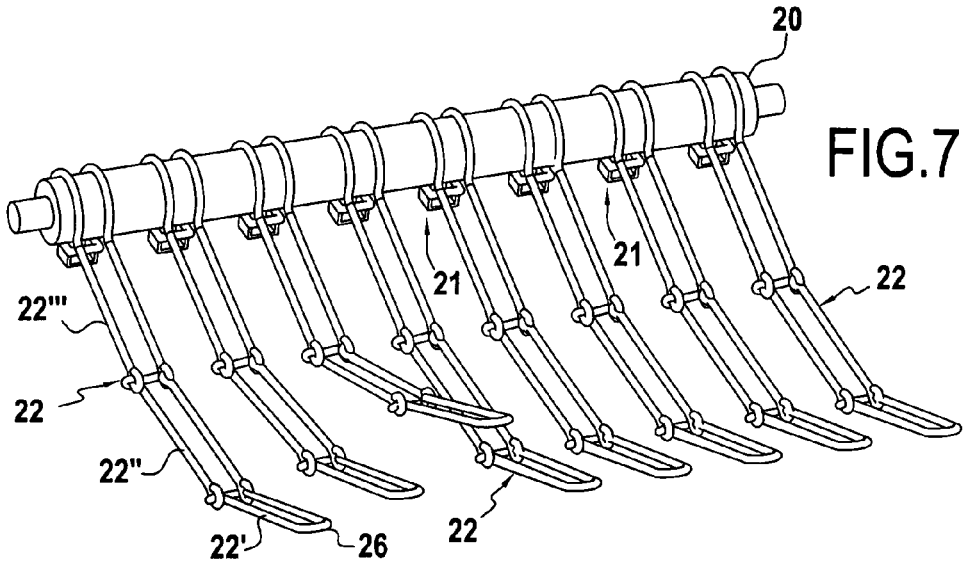
Figure 8:
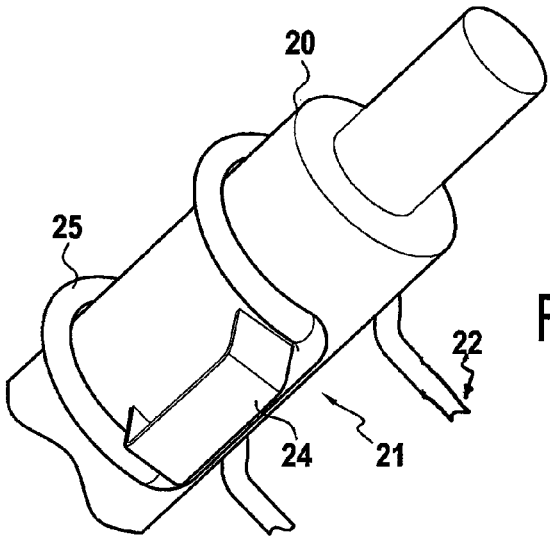

FIG. 4 represents a simplified, partial view illustrating the operation of the installation according to the invention, FIGS. 5 and 6 represent a second embodiment with a view in perspective and according to the invention, FIG. 7 represents a partial view of the embodiment represented in FIGS. 5 and 6, FIG. 8 represents a detail of the second embodiment represented in FIGS. 5 to 7, FIGS. 9*a* to 9*c* represent three variants of an articulated arm.

Figure 1:
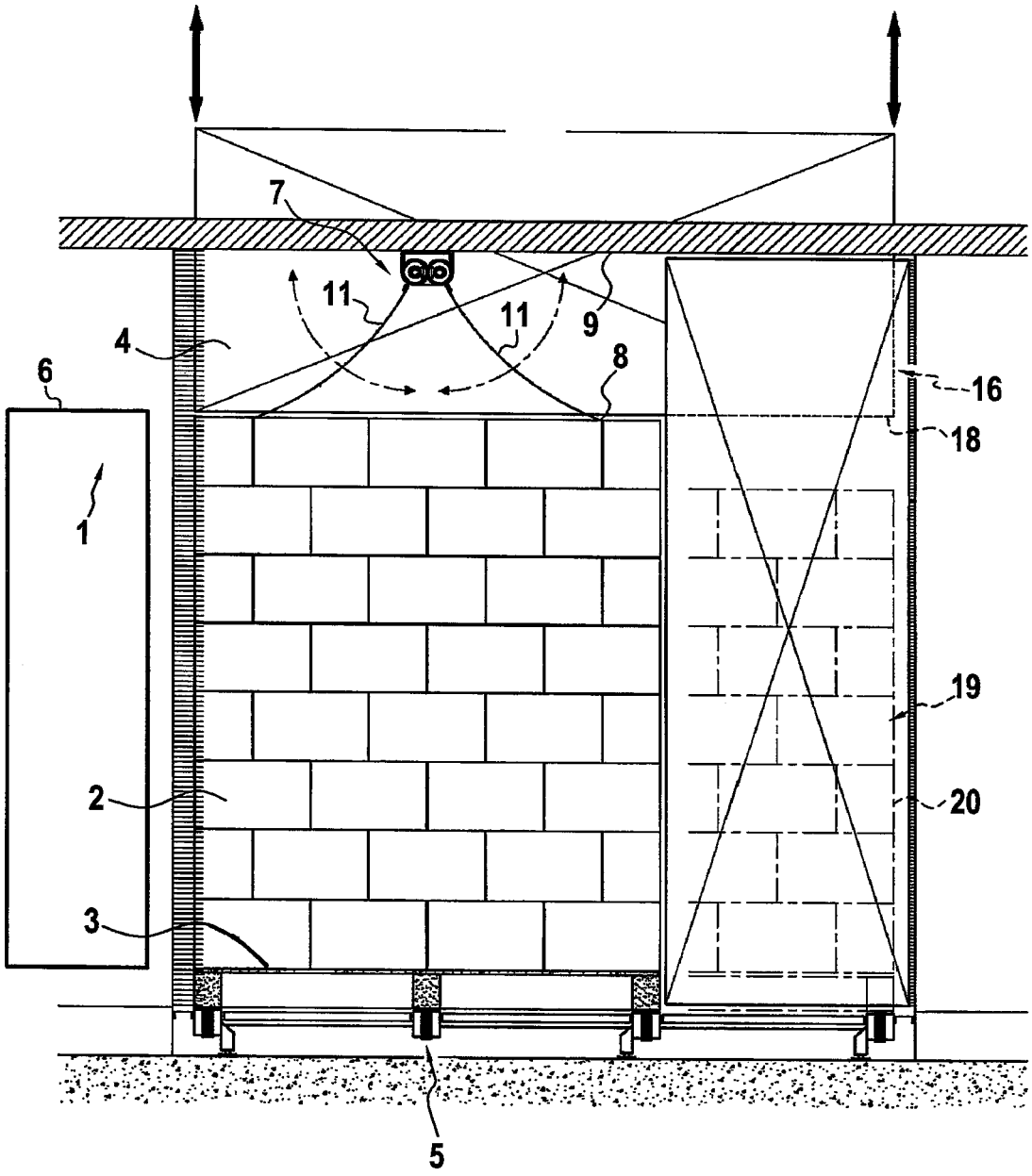
FIG. 1 represents a view in cross section of an installation implemented according to the invention.

Referring now particularly to FIG. 1, this illustrates an installation 1 for the temperature treatment of products 2 placed on a pallet 3 or similar.

This installation 1 includes means for the introduction of a pallet, though these means are not represented on the appended drawings but are well known to those skilled in the art.

The installation 1 also includes means 5 for the conveyance of the pallet between an entrance and an exit of the installation 1, as well as means 6 for blowing air through the products 2 on the pallet 3.

According to the invention, the installation 1 also includes raisable, longitudinal, separation means 7.

These separation means 7 are placed substantially on the main axis of the said at least one chamber, and are used to prevent the passage of air between the top surface 8 of each pallet 3 and the ceiling 9 of the said at least one chamber 4.

Advantageously, these longitudinal separation means 7 will span the whole length of the chamber 4, and longitudinal separation means 7 will be provided in each chamber 4.

According to other embodiments, it is also possible, of course, to arrange that some chambers 4 are not fitted with these longitudinal separation means 7, including the final so-called exit chamber for example.

Figure 2:
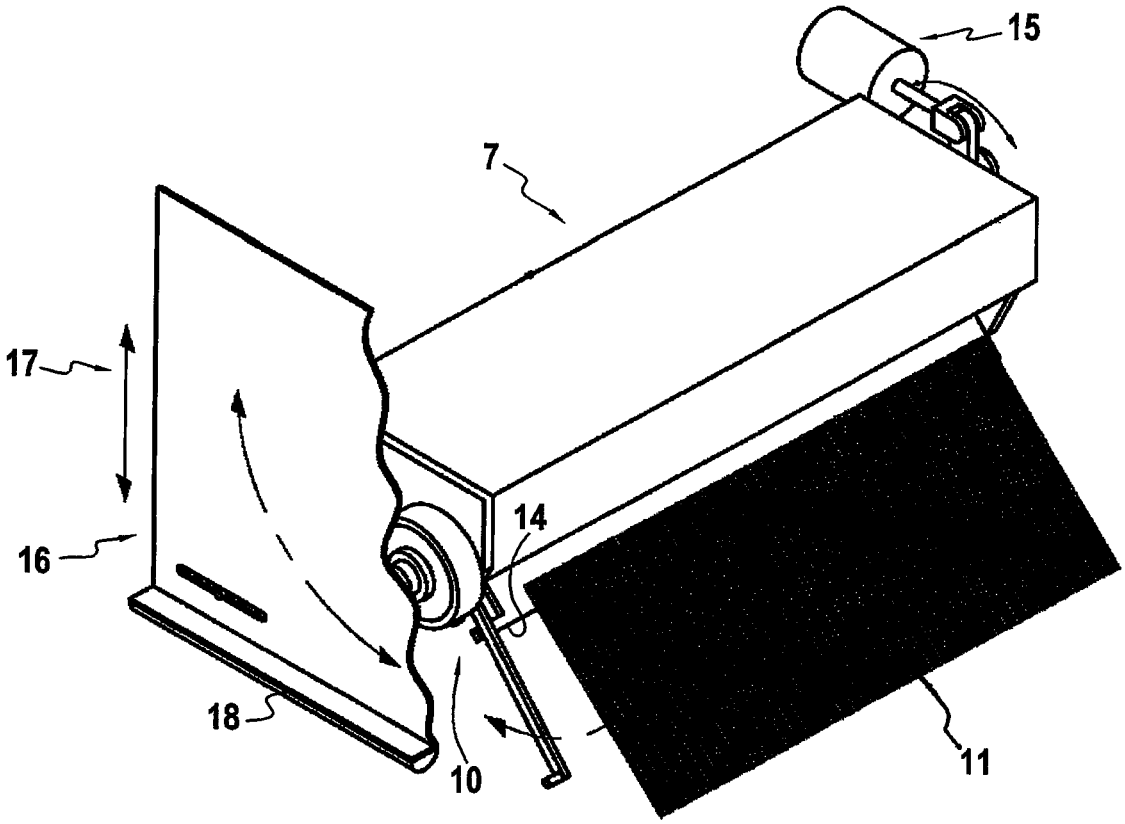
FIG. 2 represents a detail of an embodiment according to the invention, in schematic perspective.
Figure 3:
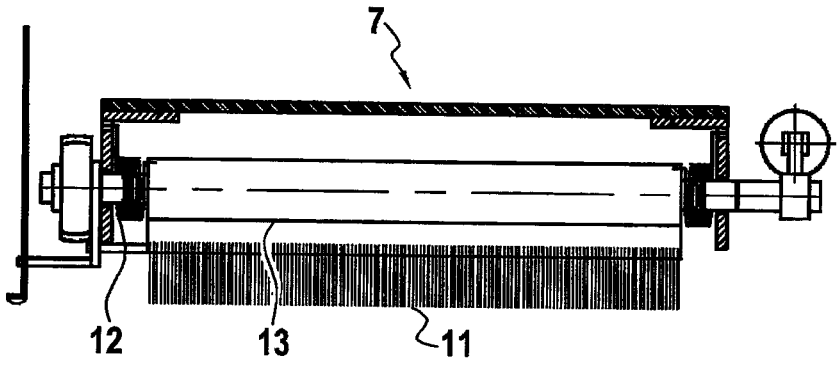
FIG. 3 represents a view in cross section of the detail represented in FIG. 2.

Referring now more particularly to FIGS. 2 and 3, it can be seen that the longitudinal separation means 7 include movement means 10 used for the positioning of flexible elements 11 providing airtightness between the ceiling 9 and the top surface 8 of each pallet 3.

More precisely, the movement means 10 allow the raising or the positioning of these flexible elements 11.

According to the embodiment described in FIGS. 1 to 4, the flexible elements 11 are divided into two rows. This arrangement is particularly favourable if one is providing air-blowing means on each side of the pallets 3 or to constitute a surface that creates a better seal.

This being so, it is also possible to envisage the creation of longitudinal separation means 7 with a single row of flexible elements 11.

According to a preferred embodiment of the invention, the movement means 10 include two tubes, internal 12 and external 13, with the external tube 13 carrying the flexible elements 11 and the internal tube 12 carrying a dog 14 which, when raised, causes the rotation of the external tube 13 and the raising of the flexible elements 11.

It can be seen in FIG. 4 that the flexible elements 11 are in the lowered position corresponding to a down position of the dog 14, with the two tubes 12, 13 being free to rotate in relation to each other. Passage from the up position to the down position is achieved by lowering the dog 14, so that the tube 13 pivots in rotation about its axis, driven by the weight of the flexible elements 11.

Passage from the down position to the up position is achieved by performing a rotation at the level of the tube 12, so that the dog 14 causes the raising of the flexible elements 11 by pushing against the latter.

The flexible elements 11 can, in particular, be composed of fibres, as represented in FIG. 4 in particular.

This is only a non-limiting example however, and it is also possible to create these flexible elements from laths.

In the example of FIGS. 1 to 4, the fibres constituting the flexible elements 11 are independent of each other. This characteristic simultaneously allows the positioning of these flexible elements 11 and elimination of the free space between the ceiling 9 and each top surface 8 of each pallet. In fact each flexible element 11 is stopped only when its extremity makes contact with the top surface 8 of the pallet.

Given the structure of these flexible elements 11, whether they are composed of laths or fibres, the contact with the top surface 8 is slight so as not to damage the products that can themselves constitute the top surface 8 of the pallet.

According to one advantageous embodiment of the invention, it can also be arranged that these flexible elements 11 are connected together at the top to form a curtain that is completely airtight.

This top part is positioned so that its bottom extremity is always above the top surface 8 of the tallest pallet 3 expected in the chamber 4.

It should also be noted that these longitudinal separation means 7 also include control means 15 that are used to drive the movement means 10, with these control means 15, in particular in the form of an actuator.

Needless to say, other devices, well known to those skilled in the art, can also be used to provide the motor-drive and control means 10.

It is also important to point out that the operation of the movement means 10 is concomitant with the operation of the conveyance means 5.

In fact before any movement of the pallets 3 by the conveyance means 5, the raising of the flexible elements 11 by the movement means 10 is first effected, preferably automatically.

When the means 5 for the conveyance of the pallet are stopped, the movement means 10 are operated and position the dog 14 in the down position, allowing the placement of the flexible elements 11 against the top surface 8 of the pallets 3.

Referring now to FIGS. 5 to 9, it can be seen that these represent a second embodiment of the longitudinal separation means 7.

In this embodiment, the longitudinal separation means 7 include a drive shaft 20, fitted with retention means 21 and used to drive the articulated arms 22 in an upward direction as illustrated in FIG. 5.

The longitudinal separation means 7 also include at least one sealing canvas 23 associated with the articulated arms 22.

Referring now more particularly to FIG. 8, we can see the retention means 21 represented in detail, with the latter including a dog 24 positioned on the drive shaft 20, so that each dog fits onto a so-called proximal end 25 of an articulated arm 22.

In FIG. 8, it can thus be seen that in the event of rotation of the drive shaft in a direction corresponding to that of the raising of the baffle 23, the dog 24 comes up against the end 25 of the articulated arm, causing it to rise.

Referring now mainly to FIG. 7, it can be seen that the arm 22 includes articulations, with the latter being positioned so that part of the bottom row 22' of the articulated arm 22 can be raised in relation to a higher, row namely 22", which itself can be raised in relation to part 22'".

This characteristic is particularly useful since, when the drive axle 20 lowers the arms 22 toward the products, it means that the force applied by the baffle 23 onto the products is spread over the bottom face of the distal end 26 of the articulated arm 22.

The raising of the lower rows in relation to the higher rows therefore allow the distribution over a large surface of the force applied by the baffle onto the products, and so avoids any damage to the palleted product.

The use of articulated arms that are all independent of each also allows compensation for the level differences of the pallets. In fact during the descent of the articulated arms 22, the dogs 24 hold the arms 22 until they stop on the pallet, and then continue to rotate, leaving the arm 22 in its place at the bottom of the descent, to the end of the rotation of the shaft 20, where all of the arms 22 have their distal ends 26 in contact with the palleted product.

Figure 9A:
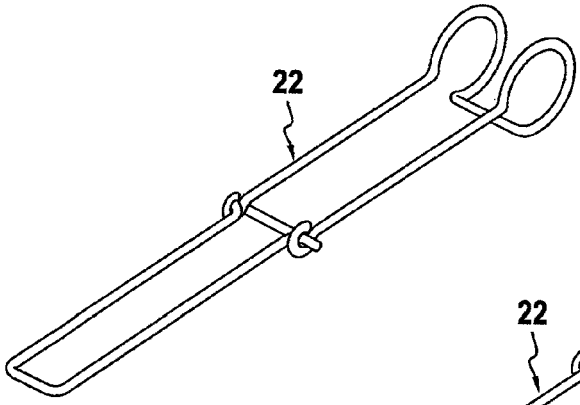
Figure 9B:
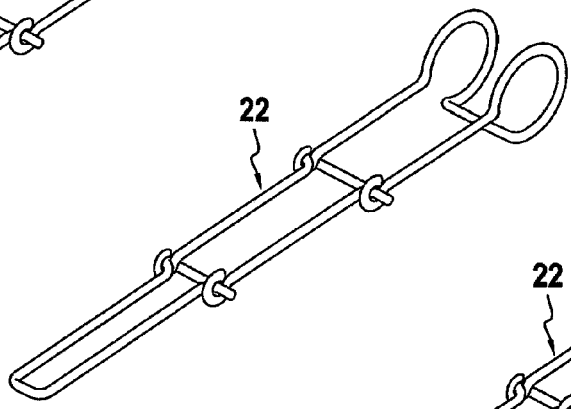
Figure 9C:
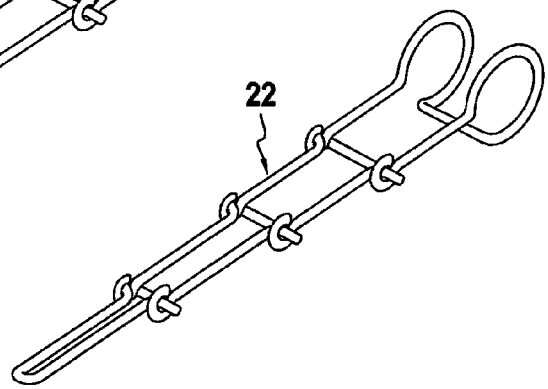

Depending on the characteristics of the tunnel, it is possible to use different types of articulated arm 22, and in particular, as illustrated in FIGS. 9*a*, 9*b* and 9*c*, it is possible to use articulated arms 22 with one, two or three articulations.

The dimensioning and also the spacing between the articulated arms 22 can be variable, and in particular the articulated arms can be spaced by 20 to 100 cm on the said drive shaft 20.

In this regard, it is important to note that the drive shaft 20 will advantageously be rotated by control means 27 that include an actuator.

Of course, other methods of implementing the control means 27, available to those skilled in the art, can also be envisaged.

According to one characteristic of the invention, the arms 22 are linked to the baffle 23 which, advantageously, includes pockets 30 used for insertion of the articulated arms 22.

According to one advantageous embodiment, the connection between the arms 22 and the sealing canvas 23 is removable.

In other embodiments however, it is possible to envisage that the fitting in the pockets 30 can be fixed in nature, or indeed that the arms 22 may not be fitted into pockets 30 but rather onto one face of the sealing canvas 23.

So as to allow angular movement between the arms 22, provision is made for bellows 28 to be arranged between the pockets 30 of the sealing canvas 23.

Advantageously, these bellows 28 will have a shape that flares toward lower end 29 of the baffle 23.

This characteristic allows the placement of two adjacent articulated arms 22 of different heights, and in particular with height differences of between 20 cm and 1 m, so that it is possible to seal off the top part of the installation even when the pallets are of widely differing height.

According to the invention, provision is also made for additional separation means 16, placed substantially at right angles to the ends of the longitudinal separation means 7, and used to prevent the passage of air between two chambers 4 at the level of the upper parts.

These additional separation means 16 include additional movement means 17 and a guillotine 18, with the additional movement means 17 allowing movement in translation of the guillotine 18 between a lower working position and a raised position.

FIGS. 1 and 4 illustrate the guillotines 18 placed in their working position, that is with their bottom ends in contact with or close to the top surface 8 of the pallet directly below it.

According to a preferred embodiment, the additional movement means 17 are synchronised with the means 10 for moving the flexible elements 11.

It is possible in particular to arrange that the movement means 10, 17 are operated by the control means 15, 27.

The association between the longitudinal separation means 7 and the additional separation means 16 result in creating a good seal at all of the upper parts, that is of the parties located above the top surface 8 of the pallets 3.

The treatment installation thus equipped is therefore particularly effective, since the air coming out of the air-blowing means 6 is necessarily forced through the pallet 3.

According to one advantageous option of the invention, it is also possible to provide for lateral sealing means 19.

To this end, it is arranged that the pallets 3 are introduced into the installation 1 so as to be aligned on one side, thus creating a reference surface to some extent.

Given the differences both of orientation of the pallets, and of the dimensions of these pallets 3, the side opposite to the aligned side displays irregularities, and as a consequence a space by which the air is able to escape.

According to the advantageous embodiment, the lateral sealing means 19 are used to fill in this space and, advantageously, in particular at the ends of the chambers 4.

These sealing means 19 can include sliding doors 20 placed substantially at right angles to the main axis of each chamber 4.

Here again, these lateral sealing means 19 will be synchronised with the conveyance means 5, with the door being moved toward the inside of the chamber 4 when the conveyance means 5 are stopped, and vice versa, with the door sliding into in the walls of the installation 1 before any movement of the conveyance means 5.

These lateral sealing means 19 also increase the energy efficiency of the treatment installation 1.

They also allow an operator to gain access without difficulty to the interior of the installation in the event of a problem, in particular during the operation of the installation. To this end, a control can be provided on the outside of the installation, allowing the opening and/or closing of all the doors 20 of the installation 1.

Needless to say, other embodiments available to those skilled in the art can also be envisaged without moving outside the scope of the invention as defined by the following claims.

The invention claimed is:

1. An installation for the temperature treatment of products placed on pallets or similar, including at least one chamber, means for the introduction of a pallet, and means for conveyance of the pallet between an entrance and an exit along a main axis of the said at least one chamber, and means for blowing air through the products on a pallet, wherein the installation also includes raisable longitudinal separation means, placed substantially on the main axis of the said at least one chamber, and used to prevent the passage of air between the top surface of each pallet present in the chamber and the ceiling of the said at least one chamber, and wherein said raisable longitudinal separation means include at least one sealing canvas linked to raisable articulated arms that are arranged substantially along the main axis and that are independent of one another in such a manner to allow compensation for level differences of the pallets and include a rotatable member connected to the raisable articulated arms for moving the raisable articulated arms up and down.

2. The treatment installation according to claim 1, in which the raisable longitudinal separation means include movement means used for raising or positioning of said at least one sealing canvas linked to said raisable articulated arms so as to provide the seal, and the movement means includes the rotatable member.

3. The temperature treatment installation according to claim 2, in which the movement means include a drive shaft fitted with retention means used to drive said raisable articulated arms in an upward direction, and said at least one sealing canvas linked to the raisable articulated arms.

4. The installation according to claim 3, in which the articulated arms placed on the drive shaft are spaced by 20 to 100 cm.

5. The installation according to claim 3, in which the drive shaft is driven in rotation by control means that include an actuator.

6. The installation according to claim 3, in which the retention means include dogs placed on the drive shaft, so that each dog fits onto a so-called proximal end of an articulated arm.

7. The installation according to claim 1, in which each articulated arm includes from one to three articulations.

8. The installation according to claim 7, in which the articulations are used to raise a lower row part of the articulated arm in relation to a higher row.

9. The installation according to claim 1, in which the force applied by the said at least one sealing canvas onto the products is distributed over the lower face of the distal end of the articulated arms.

10. The installation according to claim 1, in which the said at least one sealing canvas includes pockets that are used for introduction of the articulated arms, and bellows between the pockets allowing angular movement between the arms.

11. The installation according to claim 10, in which the bellows have a shape that flares toward the bottom end of the said at least one sealing canvas.

12. The installation according to claim 1, in which the said at least one sealing canvas includes pockets and a bellows between the pockets, the articulated arms being introduced into the pockets with the bellows configured to allow independent raising of the articulated arms in neighboring pockets.

* * * * *

UNITED STATES PATENT AND TRADEMARK OFFICE

CERTIFICATE OF CORRECTION

PATENT NO. : 8,459,180 B2
APPLICATION NO. : 11/919547
DATED : June 11, 2013
INVENTOR(S) : Paupardin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1111 days.

Signed and Sealed this
Eighth Day of September, 2015

Michelle K. Lee

Michelle K. Lee
*Director of the United States Patent and Trademark Office*